US008077116B2

(12) United States Patent
Shamblin et al.

(10) Patent No.: US 8,077,116 B2
(45) Date of Patent: Dec. 13, 2011

(54) ANTENNA WITH ACTIVE ELEMENTS

(75) Inventors: Jeffrey Shamblin, San Marcos, CA (US); Chulmin Han, San Diego, CA (US); Rowland Jones, Carlsbad, CA (US); Sebastian Rowson, San Diego, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 12/894,052

(22) Filed: Sep. 29, 2010

(65) Prior Publication Data

US 2011/0012800 A1 Jan. 20, 2011

Related U.S. Application Data

(63) Continuation of application No. 11/841,207, filed on Aug. 20, 2007, now Pat. No. 7,830,320.

(51) Int. Cl.
*H01Q 1/36* (2006.01)

(52) U.S. Cl. ..... 343/895; 343/700 MS

(58) Field of Classification Search ..... 343/895, 343/700 MS, 702, 747, 745, 749
See application file for complete search history.

(56) References Cited

U.S. PATENT DOCUMENTS

| | | | | |
|---|---|---|---|---|
| 5,966,097 | A * | 10/1999 | Fukasawa et al. | 343/700 MS |
| 7,271,770 | B2 * | 9/2007 | Washiro | 343/702 |
| 7,372,406 | B2 * | 5/2008 | Shiotsu et al. | 343/700 MS |
| 2003/0098812 | A1 * | 5/2003 | Ying et al. | 343/702 |
| 2006/0152411 | A1 * | 7/2006 | Iguchi et al. | 343/700 MS |

* cited by examiner

*Primary Examiner* — Hoanganh Le
(74) *Attorney, Agent, or Firm* — Coastal Patent Agency

(57) ABSTRACT

A multi-frequency antenna comprising an IMD element, one or more active tuning elements and one or more parasitic elements. The IMD element is used in combination with the active tuning and parasitic elements for enabling a variable frequency at which the antenna operates, wherein, when excited, the parasitic elements may couple with the IMD element to change an operating characteristic of the IMD element.

18 Claims, 10 Drawing Sheets

FIG. 14a
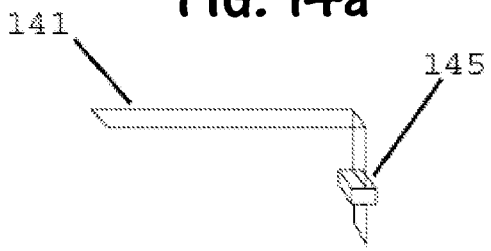
FIG. 14b
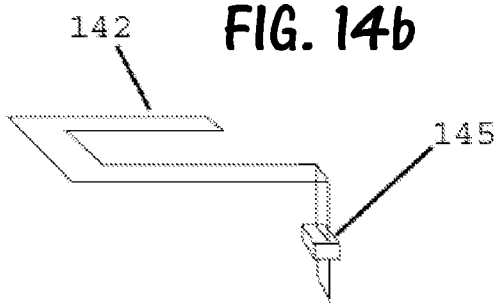
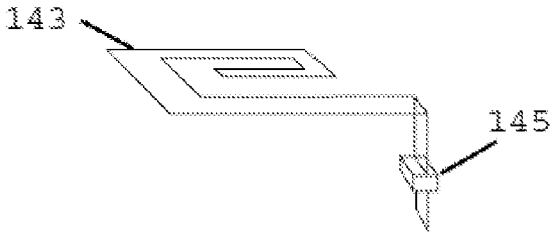
FIG. 14c
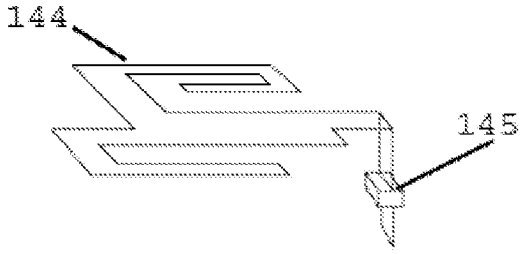
FIG. 14d
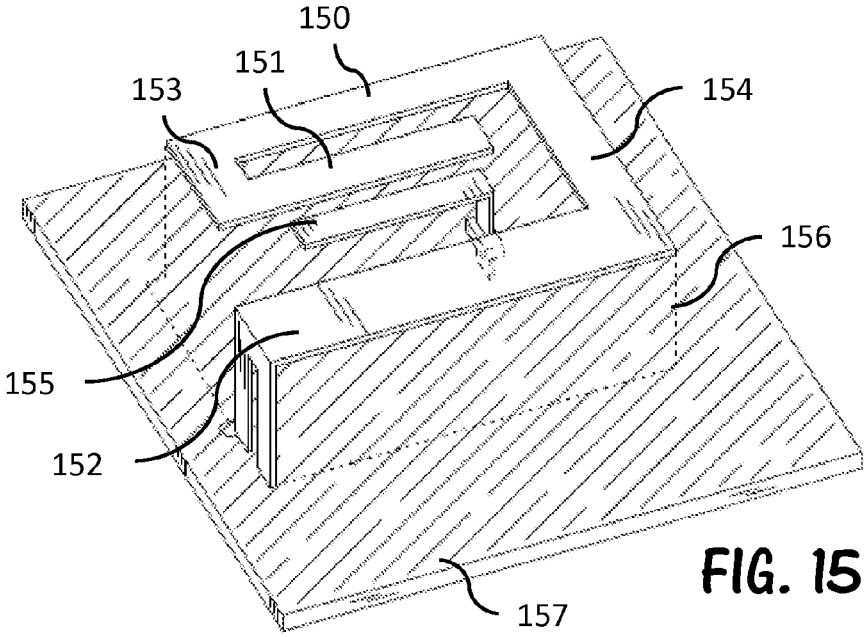
FIG. 15

ANTENNA WITH ACTIVE ELEMENTS

CROSS-REFERENCE TO RELATED APPLICATIONS

This is a continuing application relating to U.S. Ser. No. 11/841,207, filed Aug. 20, 2007, and title "ANTENNA WITH ACTIVE ELEMENTS".

FIELD OF INVENTION

The present invention relates generally to the field of wireless communication. In particular, the present invention relates to an antenna for use within such wireless communication.

BACKGROUND OF THE INVENTION

As new generations of handsets and other wireless communication devices become smaller and embedded with more and more applications, new antenna designs are required to address inherent limitations of these devices. With classical antenna structures, a certain physical volume is required to produce a resonant antenna structure at a particular radio frequency and with a particular bandwidth. In multi-band applications, more than one such resonant antenna structure may be required. With the advent of a new generation of wireless devices, such classical antenna structure will need to take into account beam switching, beam steering, space or polarization antenna diversity, impedance matching, frequency switching, mode switching, etc., in order to reduce the size of devices and improve their performance.

Wireless devices are also experiencing a convergence with other mobile electronic devices. Due to increases in data transfer rates and processor and memory resources, it has become possible to offer a myriad of products and services on wireless devices that have typically been reserved for more traditional electronic devices. For example, modern day mobile communications devices can be equipped to receive broadcast television signals. These signals tend to be broadcast at very low frequencies (e.g., 200-700 Mhz) compared to more traditional cellular communication frequencies of, for example, 800/900 Mhz and 1800/1900 Mhz.

In addition, the design of low frequency dual band internal antennas for use in modern cell phones poses other challenges. One problem with existing mobile device antenna designs is that they are not easily excited at such low frequencies in order to receive all broadcasted signals. Standard technologies require that antennas be made larger when operated at low frequencies. In particular, with present cell phone, PDA, and similar communication device designs leading to smaller and smaller form factors, it becomes more difficult to design internal antennas for varying frequency applications to accommodate the small form factors. The present invention addresses the deficiencies of current antenna design in order to create more efficient antennas with a higher bandwidth.

SUMMARY OF THE INVENTION

In one aspect of the present invention, a multi-frequency antenna comprises an Isolated Magnetic Dipole™ (IMD) element, one or more parasitic elements and one or more active tuning elements, wherein the active elements are positioned off the IMD element.

In one embodiment of the present invention, the active tuning elements are adapted to vary the frequency response of the antenna.

In one embodiment, the parasitic elements are located below the IMD element. In another embodiment, the parasitic elements are located off the IMD element. In one embodiment, the active tuning elements are positioned on one or more parasitic elements.

In another embodiment, the active tuning elements and parasitic elements may be positioned above the ground plane. In yet another embodiment, the one or more parasitic elements are positioned below the IMD element and a gap between the IMD element and the parasitic element provides a tunable frequency. Further, another embodiment provides that the parasitic element has an active tuning element at the region where one of parasitic element connects to the ground plane.

In another embodiment of the present inventions provides that the multi-frequency antenna contains multiple resonant elements. Further, the resonant elements may each contain active tuning elements.

In another embodiment of the present invention, the antenna has an external matching circuit that contains one or more active elements.

In one embodiment, the active tuning elements utilized in the antenna are at least one of the following: voltage controlled tunable capacitors, voltage controlled tunable phase shifters, FET's, and switches.

Another aspect of the invention relates to a method for forming a multi-frequency antenna that provides an IMD element above a ground plane, one or more parasitic elements, and one or more active tuning elements all situated above the ground plane, and the active tuning element positioned off the IMD element.

Yet another aspect of the present invention provides an antenna arrangement for a wireless device that includes an IMD element, one or more parasitic elements, and one or more active tuning elements, where the IMD element may be located on a substrate, while the active tuning element is located off the IMD element. In a further embodiment, one or more parasitic elements are utilized to alter the field of the IMD element in order to vary the frequency of the antenna.

BRIEF DESCRIPTION OF THE DRAWINGS

FIG. 14*a*-14*d* illustrate parasitic elements of various shapes according to embodiments of the present invention.

FIG. 15 illustrates a planar IMD antenna element disposed above a ground plane forming a volume of the antenna between the conductor portions and the ground plane; a parasitic element is positioned within the volume of the antenna.

DETAILED DESCRIPTION OF THE PREFERRED EMBODIMENTS

Figure 1:
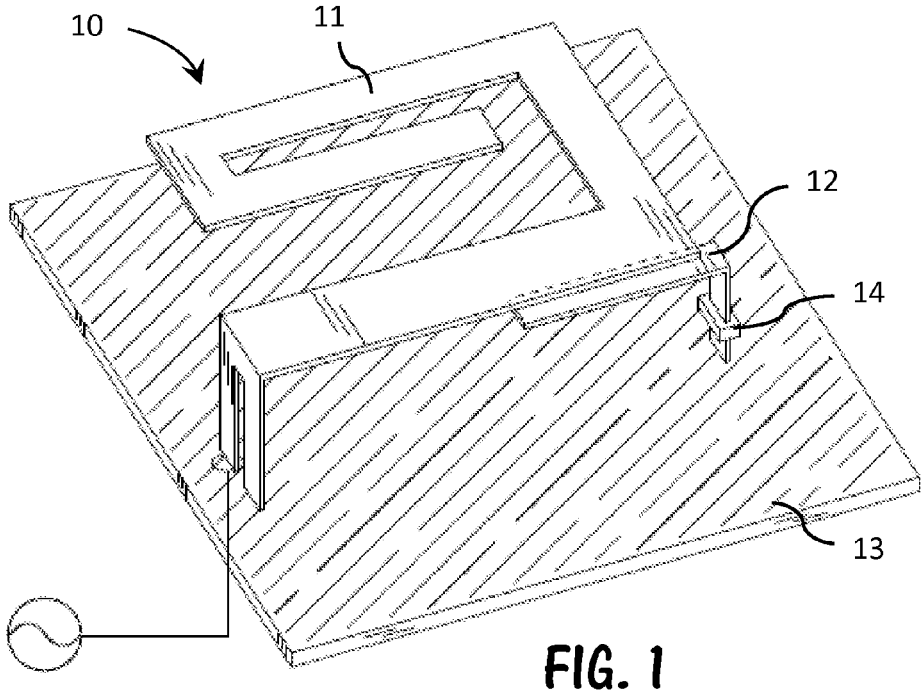
FIG. 1 illustrates an embodiment of an antenna according to the present invention.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

The term "Isolated Magnetic Dipole (IMD)" is used throughout the application to describe an spiral-shaped conductor element having at least two conductor portions disposed substantially parallel to one another forming a capacitive seam therebetween, and each of the at least two conductor portions individually connected to a perpendicular conductor portion such that a spiral current may flow through the antenna element for generating an inductive loop current; the IMD antenna thereby having a capacitive and inductive characteristic. In a particular embodiment as illustrated in FIGS. 15-18, a dual resonance IMD antenna is provided having a first parallel conductor portion, a second parallel conductor portion, and a third parallel conductor portion each disposed within a common horizontal plane at a distance above a ground plane. The first parallel conductor portion is connected to the second parallel conductor portion by a first perpendicular conductor portion; the first perpendicular conductor portion is also disposed within a common horizontal plane of the parallel conductor portions. The first parallel conductor portion is further connected to the third parallel conductor portion by a second perpendicular conductor portion; the second perpendicular conductor portion is disposed in a common plane with the first perpendicular conductor portion and the first through third parallel conductor portions at a distance above the ground plane. Other configurations of IMD antennas are known in the art, and may be configured horizontally as illustrated herein, or vertically; in which case the embodiments illustrated herein can be modified accordingly to bring about similar results.

One having skill in the art will recognize that the inductive component of the IMD antenna is substantially confined within the volume of the antenna, thereby reducing coupling to nearby components of the device circuitry. Additionally, one would recognize that the capacitive component of the antenna can be configured to cancel the inductive reactance for matching the antenna. The magnetic dipole generated by the IMD antenna is thereby isolated from device circuitry resulting in improved performance of the antenna. In certain embodiments of the invention, the IMD antenna is improved by further tuning the frequency of the antenna using one or more parasitic elements within a volume of the antenna, and particularly within a slot region of the IMD antenna. The inventors of the present application have discovered that placing a parasitic element in one or more locations of the slot region of an IMD antenna results in a frequency shift that can be used to tune the antenna to a desired bandwidth. Furthermore, by coupling the parasitic element to an active component, the coupling of the parasitic can be switched on/off, or variably tuned using a varactor or similar diode, such that the IMD antenna is adapted to operate over a larger bandwidth and tuned to a desired frequency. In this regard, the IMD antennas disclosed herein provide a significant improvement over prior art antennas.

Referring to FIG. 1, an antenna 10 in accordance with an embodiment of the present invention includes an Isolated Magnetic Dipole (IMD) element 11 and a parasitic element 12 with an active tuning element 14 situated on a ground plane 13 of a substrate. In this embodiment, the active tuning element 14 is located on the parasitic element 12 or on a vertical connection thereof. The active tuning element can be any one or more of voltage controlled tunable capacitors, voltage controlled tunable phase shifters, FET's, switches, MEMs device, transistor, or circuit capable of exhibiting ON-OFF and/or actively controllable conductive/inductive characteristics, for example. Further, in this embodiment, the distance between the IMD element 11 and the ground plane 13 is greater than the distance between the parasitic element 12 and the ground plane 13. The distance can be varied in order to adjust the frequency due to the coupling between the parasitic element 14 and the IMD element 11. The current is driven mainly through the IMD element 11 which, in turn, allows for improved power handling and higher efficiency.

The IMD element is used in combination with the active tuning for enabling a variable frequency at which the communications device operates. As well, the active tuning elements are located off of the IMD element in order to control the frequency response of the antenna. In one embodiment, this is accomplished through the tuning of one or more parasitic elements. The parasitic elements, which may be positioned below, above, or off center of the IMD element, couple with the IMD element in order to change one or more operating characteristic of the IMD element. In one embodiment, the parasitic element when excited exhibits a quadrapole-type of radiation pattern. In addition, the IMD element may comprise a stub type antenna.

The adjustment of the active tuning elements as well as the positioning of the parasitic elements allows for increased bandwidth and adjustment of the radiation pattern. The parasitic location, length, and positioning in relation to the IMD element allows for increased or decreased coupling and therefore an increase or decrease in frequency of operation and a modification of radiation pattern characteristics. The active tuning elements being located on the parasitic allows for finer adjustment of the coupling between the IMD and parasitic and, in turn, finer tuning of the frequency response of the total antenna system.

Figure 2:
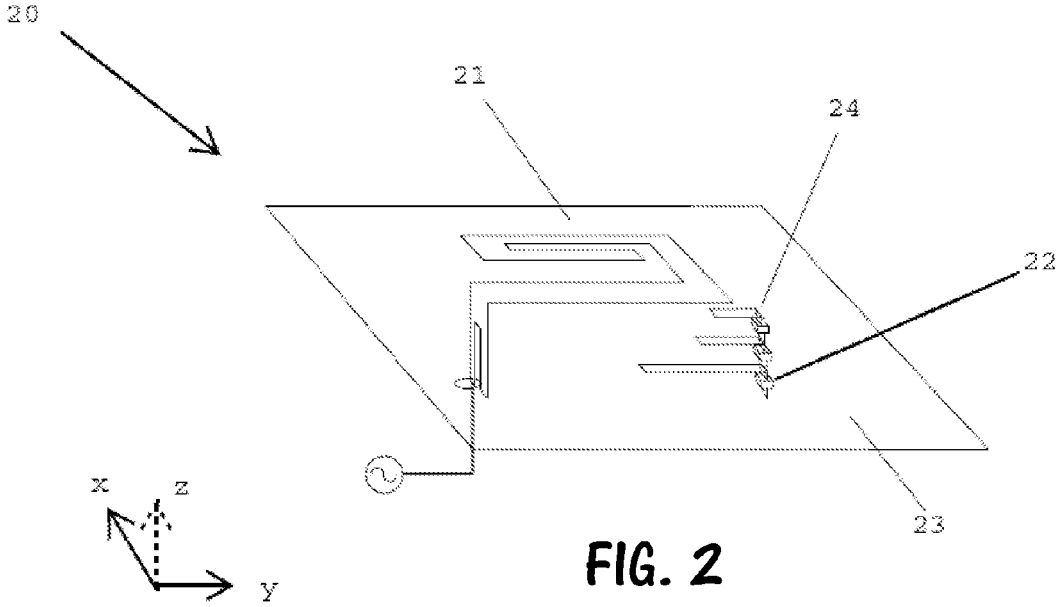
FIG. 2 illustrates another embodiment of an antenna according to the present invention.

FIG. 2 illustrates another embodiment of an antenna 20 with an IMD element 21 and one or more parasitic elements 24 with active tuning elements 22. All elements are situated on a ground plane. However, in this embodiment, the multiple parasitic elements 24 are aligned in an x-y plane being placed one above another for multiple levels of tuning adjustments. The distance between the ground plane and the parasitic elements varies along with the distance between the parasitic and the IMD element. This allows variations in the frequency response and/or radiation patterns from coupling. The parasitic element in this embodiment also has multiple portions varying in length on the y-axis, again in order to further manipulate the radiation pattern created by the IMD element. The current is still driven only through the IMD element, providing increased efficiency of the antenna 20.

Figure 3:
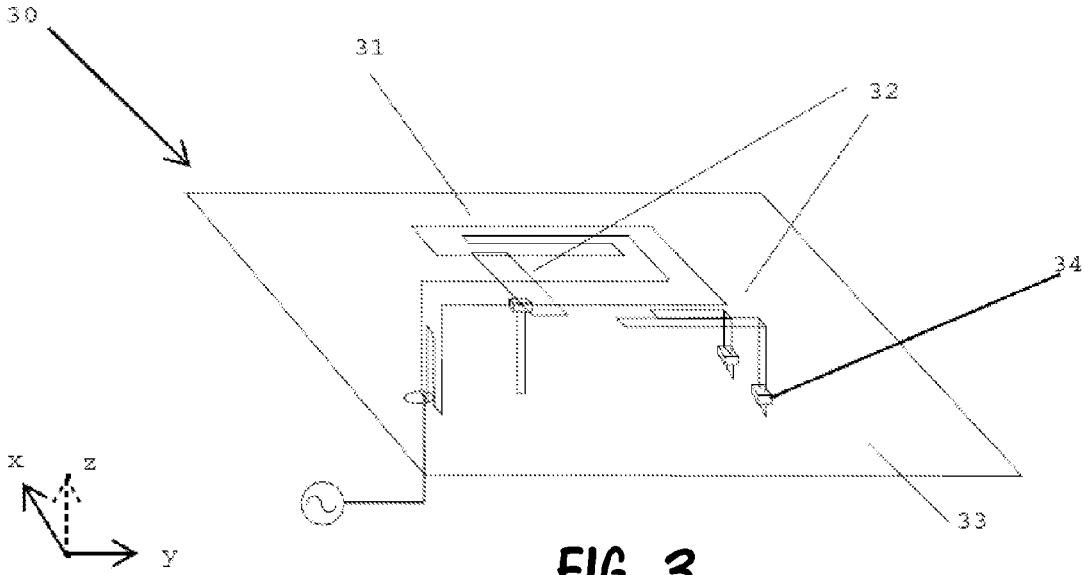
FIG. 3 illustrates an embodiment of an antenna according to the present invention with multiple parasitic elements distributed around an IMD element with active tuning elements.

FIG. 3 illustrates yet another embodiment to vary the transmitted signal from the IMD element 31. In this embodiment, the antenna 30 includes an IMD element 31 and multiple parasitic elements 32. Each of the parasitic elements 32 has active tuning elements 34 attached to them. The active tuning elements 34 are situated on a ground plane 33 of the antenna 30. In this embodiment, the parasitic elements 32 are distributed around the IMD element 31. As shown, the parasitic elements 34 may vary in both length in the x and y plane, and distance to the IMD element 31 in the z direction. The surface area variation as well as the proximity to the IMD element allow for control of the coupling between the parasitic and IMD element and an increased variance in the radiation pattern of the IMD element 31 which can then be adjusted to a desired frequency by the active tuning elements 33 on each respective parasitic element 32.

Figure 4:
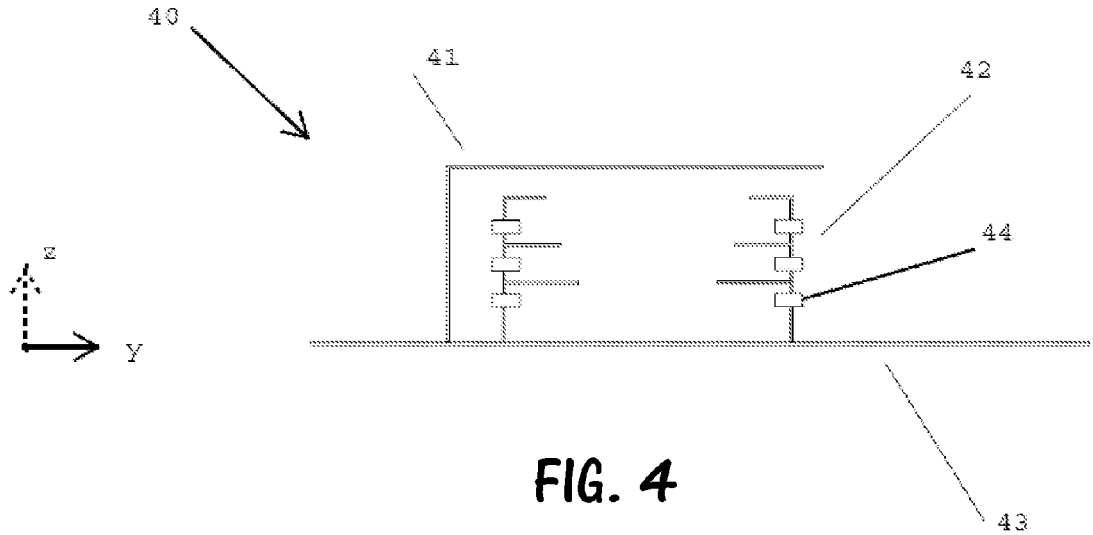
FIG. 4 illustrates a side view of another embodiment of an antenna according to the present invention having multiple parasitic elements with active tuning elements.

FIG. 4 illustrates a side view of an embodiment of an antenna 40 with a general configuration containing an IMD element 41 situated slightly above multiple parasitic elements 42 and multiple active tuning elements 44. All elements again are situated on a ground plane 43, with connectors extending vertically into the z direction. However, dependent on the configuration of the device in which they are placed, the elements could be located within any plane and should not be limited to those provided in the exemplary embodiments. In this embodiment, multiple active tuning elements 44 are located on the parasitic element 42, varying in stationary height and, in turn, distance to the IMD element 41. As well, the active tuning elements 44 are located between multiple parasitic elements 42 that extend and vary horizontally in length. In this configuration, each respective active tuning element is able to control the parasitic element located directly above it, further controlling the frequency output of the antenna. Because the distance and surface area of the multiple parasitics 42 vary in relation to the IMD element 41 and with each other, more variation is achievable.

Figure 5:
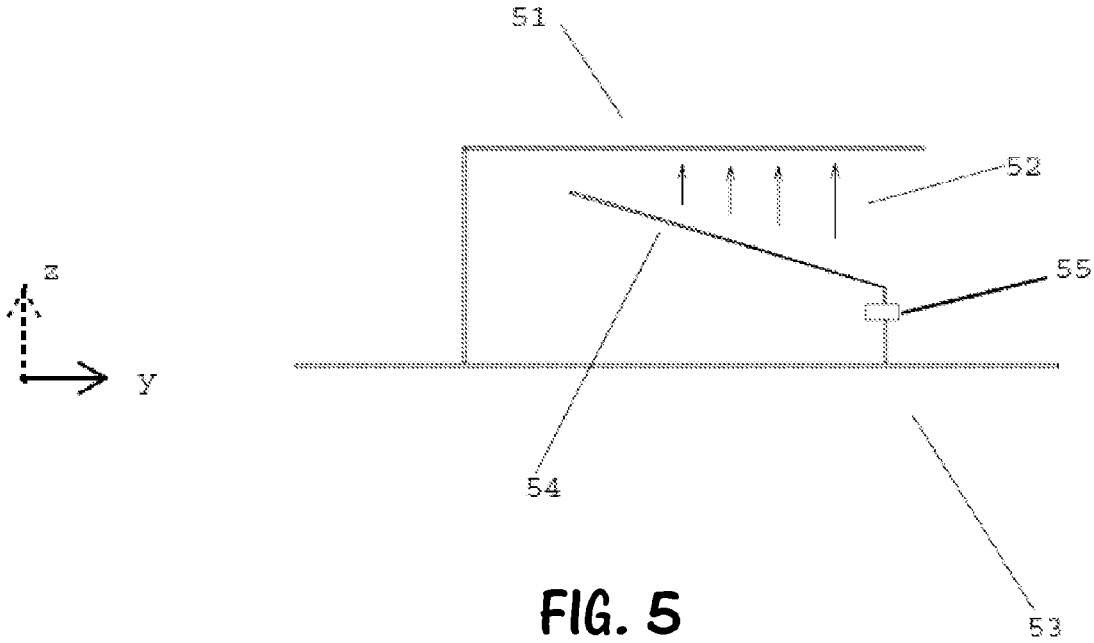
FIG. 5 illustrates a side view of an embodiment of an antenna according to the present invention having a parasitic element with varying height and active tuning element.

In another embodiment, FIG. 5 provides a configuration in which a singular parasitic element 54 may vary in height in the z direction, above the ground plane 53. In this regard, the parasitic element 54 is configured as a plate that is not parallel to the IMD element 51. Rather, the parasitic element 54 is configured such that a free end is positioned closer to the IMD element 51 than an end connected to a vertical connector. Again, an IMD element 51, the parasitic element 54 and an active tuning element 55 are all situated on a ground plane, with the active tuning element 55 being located on the parasitic element 54. Because the singular parasitic element 54 may vary in height above the ground plane, it allows for more control over the coupling between the IMD element 51 and the parasitic element 54. This feature creates a coupling region 52 between the IMD element 51 and the parasitic element 54. In addition, the active tuning element 55 may further vary the coupling between the parasitic element 54 and the IMD element 51. The length on the parasitic element 54 in the x axis may be substantially longer than in other embodiments, providing more surface area to better couple to the IMD element 51, and further manipulation of the frequency response and/or the radiation patterns produced. The length of the variable height parasitic may also be much shorter, dependent of the amount of coupling, and, consequently, frequency variance desired.

Figure 6:
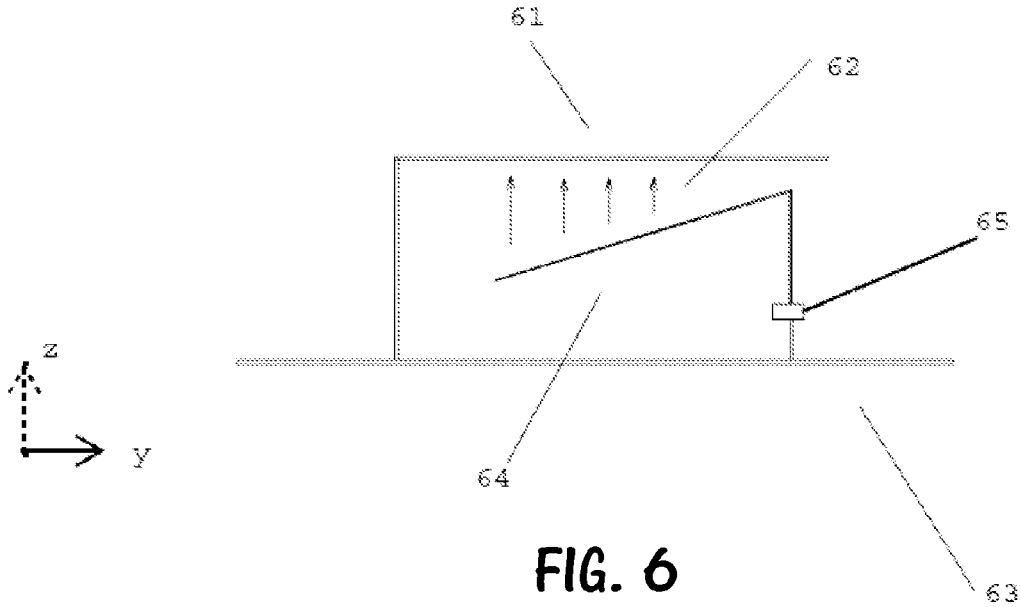
FIG. 6 illustrates a side view of another embodiment of an antenna according to the present invention having a parasitic element with varying height and active tuning element.

In a similar embodiment, FIG. 6 provides a variation of the concept provided in FIG. 5, with the parasitic element 64 again varying in height on the z axis. In the embodiment of FIG. 6, the parasitic element 64 is configured such that a free end is positioned further from the IMD element 61 than the end connected to the vertical connector. As discussed in FIG. 5, the length of the parasitic element 64 may vary and in this embodiment the height of the parasitic element 64 in relation to the IMD element 61 may also vary due to the directional change of the ascending height portion of the parasitic. This variance again affects the coupling by the parasitic to the IMD element. Being at a distance more proximate to the IMD element 61, the coupling region 62 is decreased, allowing for slightly less variance in coupling and a more stable control over the frequency output of the antenna. The length of the parasitic element 64, similar to that in FIG. 5, is longer than in other embodiments, and may be shorter if less coupling is necessary. The active tuning element 65 is still located on the parasitic element 64 allowing for even further control of frequency characteristics of the antenna.

Figure 7:
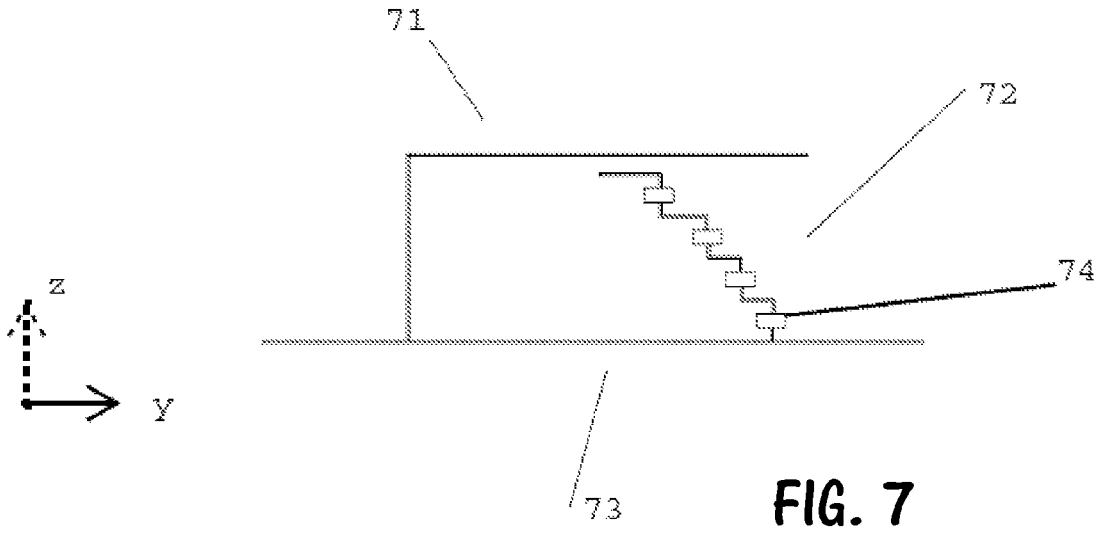
FIG. 7 illustrates a side view of another embodiment of an antenna according to the present invention having a parasitic element with varying height and active tuning element.

FIG. 7 provides an exemplary embodiment similar to FIG. 5, wherein multiple parasitic elements 72 are varied in height in relation to the IMD element 71 and the ground plane 73. Instead of a continual descent or ascent of the portion of the parasitic element 64 with one active tuning element 65, this embodiment includes a stair step configuration with multiple active tuning elements 74 to control the frequency to a specific output. One or more portions of the smaller parasitic steps may be individually tuned to achieve the desired frequency output of the antenna.

Figure 8:
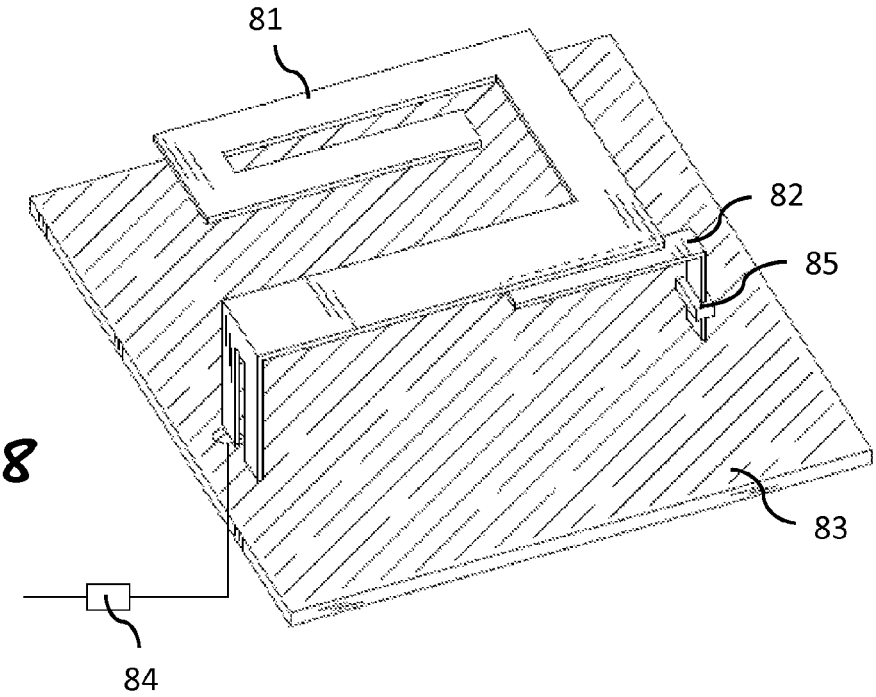
FIG. 8 illustrates an antenna according to the present invention having a parasitic element with active tuning element included in an external matching circuit.

Next, referring to the embodiment provided in FIG. 8, an IMD element 81 and parasitic element 82 with active tuning element 85 are all situated on a ground plane 83. In this embodiment, an active element is included in a matching circuit 84 external to the antenna structure. The matching circuit 84 controls the current flow into the IMD element 81 in order to match the impedance between the source and the load created by the active antenna and, in turn, minimize reflections and maximize power transfer for larger bandwidths. Again, the addition of the matching circuit 84, allows for a more controlled frequency response through the IMD element 81. The active matching circuit can be adjusted independently or in conjunction with the active components positioned on the parasitic elements to better control the frequency response and/or radiation pattern characteristics of the antenna.

Figure 9:
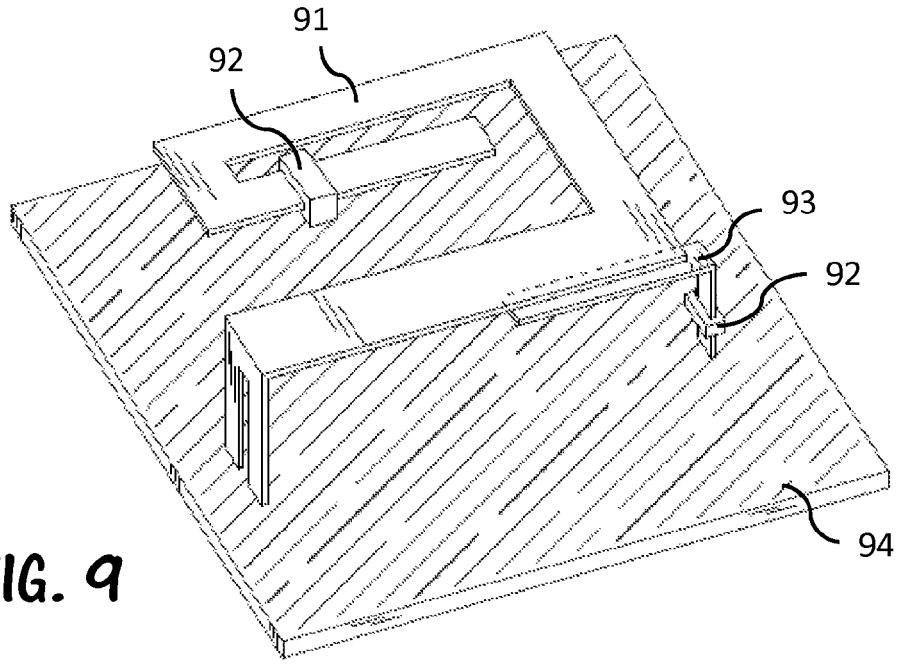
FIG. 9 illustrates an antenna according to the present invention having an active tuning element and a parasitic element with an active tuning element.

In another embodiment, FIG. 9 illustrates another configuration where IMD element 91 with an active tuning element 92 are incorporated on the IMD element 91 structure and situated on the ground plane 94. Similar to previous embodiments, the parasitic element 93 also has an active tuning element 92 in order to adjust the coupling of the parasitic 93 to the IMD element 91. In this embodiment, the addition of the active tuning element 92 on the IMD element 91 comprises a device that may exhibit ON-OFF and/or controllable capacitive or inductive characteristics. In one embodiment, active tuning element 92 may comprise a transistor device, a FET device, a MEMs device, or other suitable control element or circuit. In an embodiment, where the active tuning element exhibits OFF characteristics, it has been identified that the LC characteristics of the IMD element 91 may be changed such that IMD element 91 operates at a frequency one or more octaves higher or lower than the frequency at which the antenna operates with a active tuning element that exhibits ON characteristics. In another embodiment, where the inductance of the active tuning element 92 is controlled, it has been identified that the resonant frequency of the IMD element 91 may be varied quickly over a narrow bandwidth.

Figure 10:
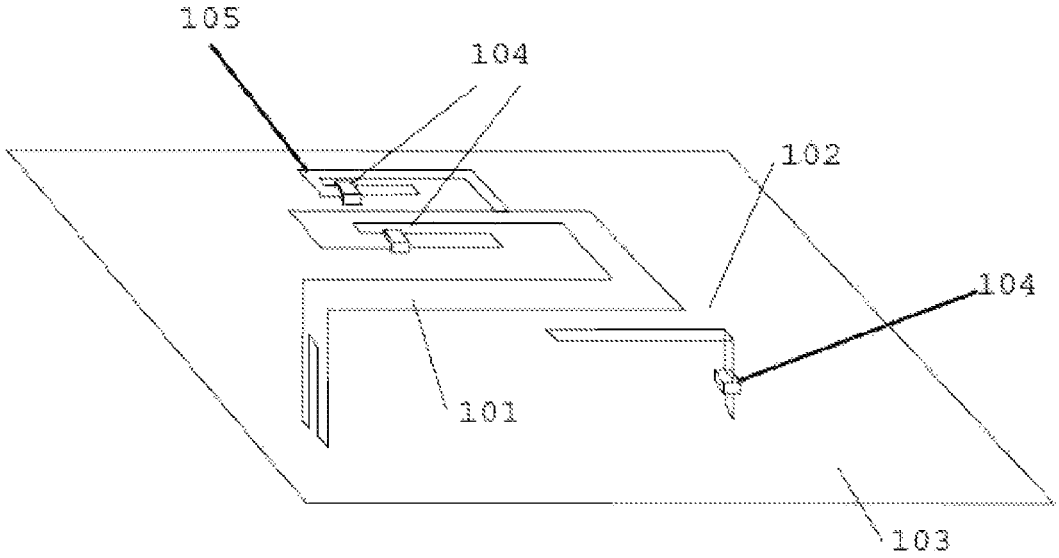
FIG. 10 illustrates an antenna according to the present invention having multiple resonant active tuning elements and a parasitic element with active tuning elements.

FIG. 10 illustrates another embodiment of an antenna wherein the IMD element 101 contains multiple resonant elements 105, with each resonant element 105 containing an active element 104. As well, a parasitic element 102 has an active tuning element 104. The parasitic and IMD elements are both situated on the ground plane 103. The addition of the resonant elements 105 to the IMD element 101, permits for multiple resonant frequency outputs through resonant interactions and modified current distributions.

Figure 11:
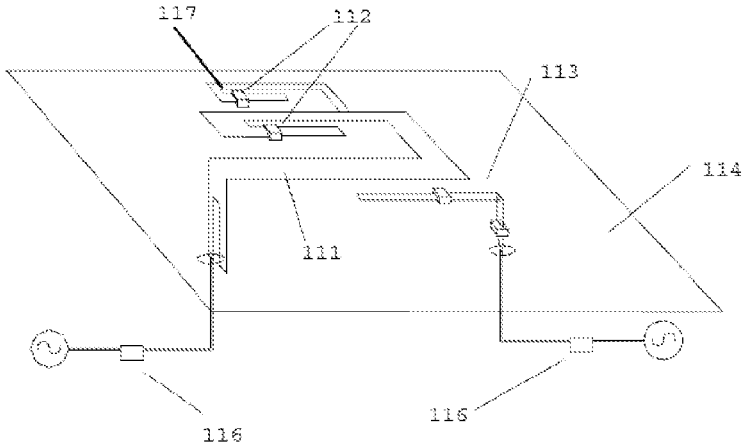
FIG. 11 illustrates another antenna according to an embodiment of the present invention with active tuning elements utilized with the main IMD element and a parasitic element.

FIG. 11 illustrates an embodiment of an antenna with various implementations of active tuning elements 115 utilized in combination with the main IMD element 111 and parasitic element 113, which are both situated on the ground plane 114 of the antenna. In this embodiment, the IMD element 111 has multiple resonant elements 117, each having an active element 115 for tuning. The parasitic element 113 has an active element 115 on the structure of the parasitic 113 as well as an active element 115 at the region where the parasitic 113 connects to the ground plane 114. As well, there is an external matching circuit 116 connected to the IMD element 111 and an external matching circuit 116 connected to the parasitic element 113. Active tuning elements 115 are also included in matching circuits 116 external to the IMD element 111 and the parasitic element 113. The addition of the elements allows for finer tuning of the precise frequency response of the antenna. Each tuning element and its location, both on the resonant elements and parasitic elements can better control the exact frequency response for the transmitted or received signal.

Figure 12A:
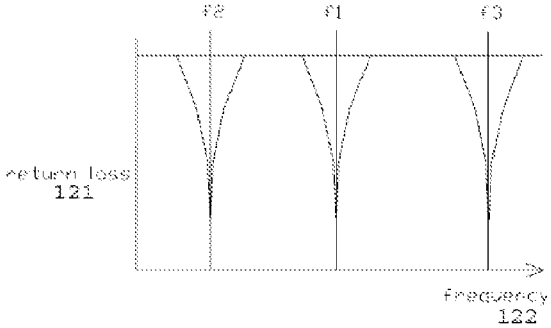
FIGS. 12*a* and 12*b* illustrate an exemplary frequency response with an active tuning element with an antenna according to an embodiment of the present invention.
Figure 12B:
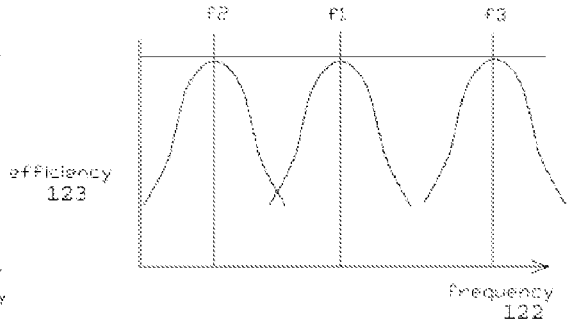

FIG. 12*a* and FIG. 12*b* provide exemplary frequency response achieved when an active tuning element positioned off the IMD element is used to vary the frequency response of the antenna. FIG. 12*a* provides a graph of the return loss 121 (y axis) versus the frequency 122 (x axis) of the antenna. The return loss displayed along the y axis of FIG. 12*a* represents a measure of impedance match between the antenna and transceiver. FIG. 12*b* provides a graph of the efficiency 123 versus the frequency 122 of the antenna. In each graph, F1 represents the frequency response of the IMD element prior to activating the tuning element, e.g. the base frequency of the antenna. F2 represents the frequency response of the antenna when the active tuning element is used to shift the frequency response lower in frequency. F3 represents the frequency response of the antenna when the active tuning element is used to shift the frequency response higher in frequency.

Figure 13A:
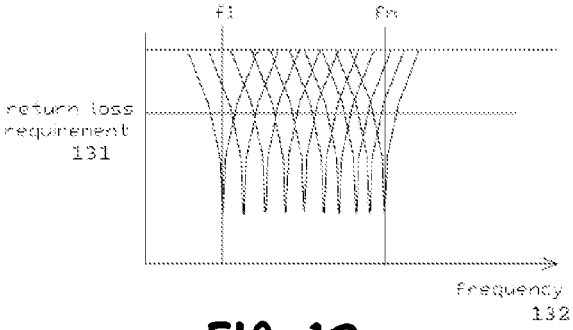
FIGS. 13*a* and 13*b* illustrate wide-band frequency coverage through adjustment of the active tuning element in an antenna according to an embodiment of the present invention.
Figure 13B:
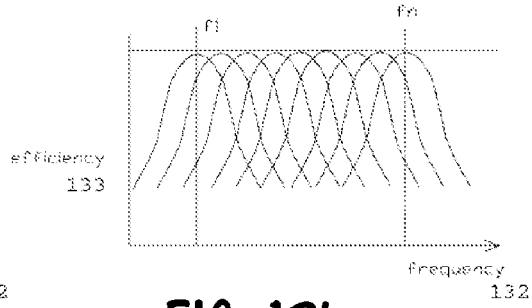

FIG. 13*a* and FIG. 13*b* provide graphs displaying exemplary embodiments where the active tuning elements are adjusted, which alters the transmitted or received signal, i.e. frequency response, of the antenna. The figures show that wide band frequency coverage can be achieved through the adjustments of the active tuning elements. A return loss requirement and efficiency variation over a wide frequency range can be also achieved by generating multiple tuning "states". This allows for the antenna to maintain both efficiency and return loss requirements even when the output frequency is manipulated.

As previously discussed, the surface area exposed to the IMD element, distance to the IMD element, and shape of the parasitic may affect the coupling and, in turn, variable frequency response and/or radiation patterns produced by the IMD element. FIGS. 14A-D provide some embodiments of the possible shapes for the parasitic element 141, 142, 143, 144. For example, in one simplistic embodiment, the parasitic element 141 provides a minimal surface area and simplistic straight shape that may be exposed to the IMD element, and tuned by the active element 145. The smaller and less exposure the parasitic provides to the IMD element means less frequency variation is achievable. For parasitic elements like the embodiments provided in 143 and 144 a larger bandwidth achievable and still actively tunable 145 in the antenna's frequency response. The shape of the parasitic element is not constrained to the types shown and can be altered to achieve the desired frequency of the antenna as needed for use within many different types of communication devices.

Turning now to FIG. 15, an IMD antenna element includes a spiral-shaped conductor having at least one slot portion, the spiral-shaped conductor further comprising a first parallel conductor portion 150, a second parallel conductor portion 151, and a third parallel conductor portion 152 each disposed substantially parallel with one another and within a common horizontal plane at a distance above a ground plane 157. A first perpendicular conductor portion 153 connects to a first end of the first parallel conductor portion 150, and extends perpendicularly therefrom to further connect to the second parallel conductor portion 151. A second perpendicular conductor portion 154 connects to a second end of the first parallel conductor portion 150, and extends perpendicularly therefrom to further connect to the third parallel conductor portion 152; the second end of the first parallel conductor portion is disposed at a side opposite of the first end. Each of the first through third parallel conductor portions 150; 151; 152 and the first and second perpendicular conductor portions 153; 154 is substantially disposed within a common horizontal plane disposed at a height above the ground plane 157 to form a volume of the IMD antenna 156 therebetween. A parasitic conductor element 155 is substantially disposed within the volume of the IMD antenna. The parasitic conductor element is connected to at least one active element for varying the coupling between the parasitic element and the IMD element.

Figure 16A:
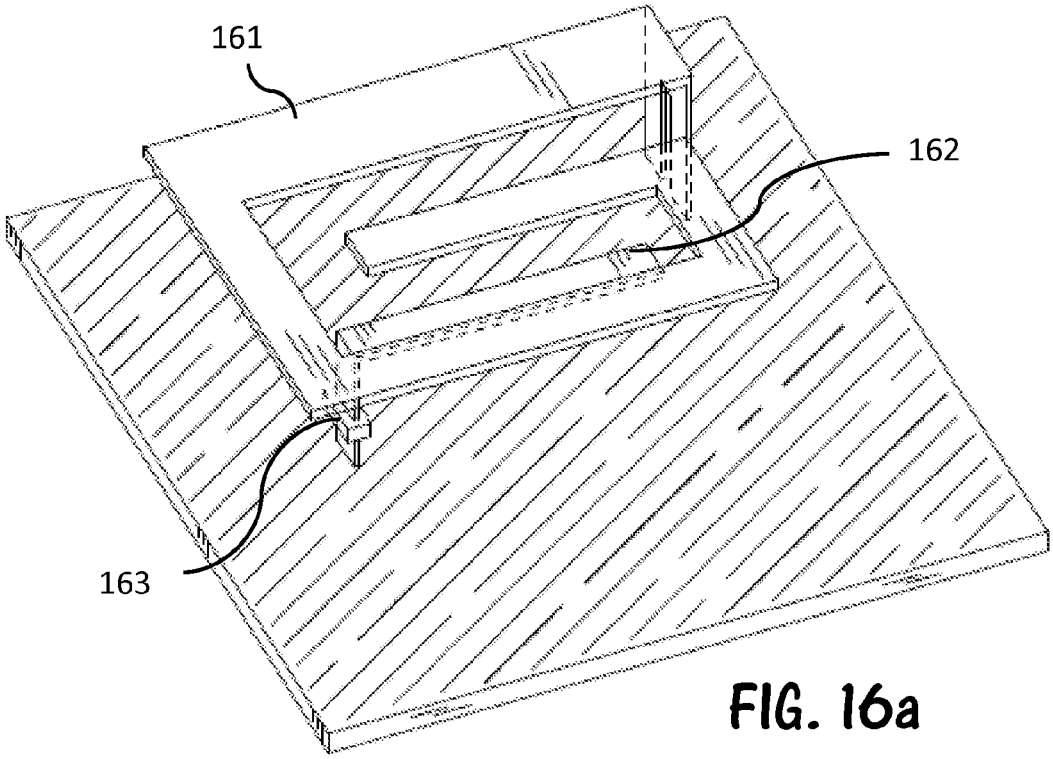
FIG. 16*a*-16*b* illustrates an antenna according to a preferred embodiment of the invention.
Figure 16B:
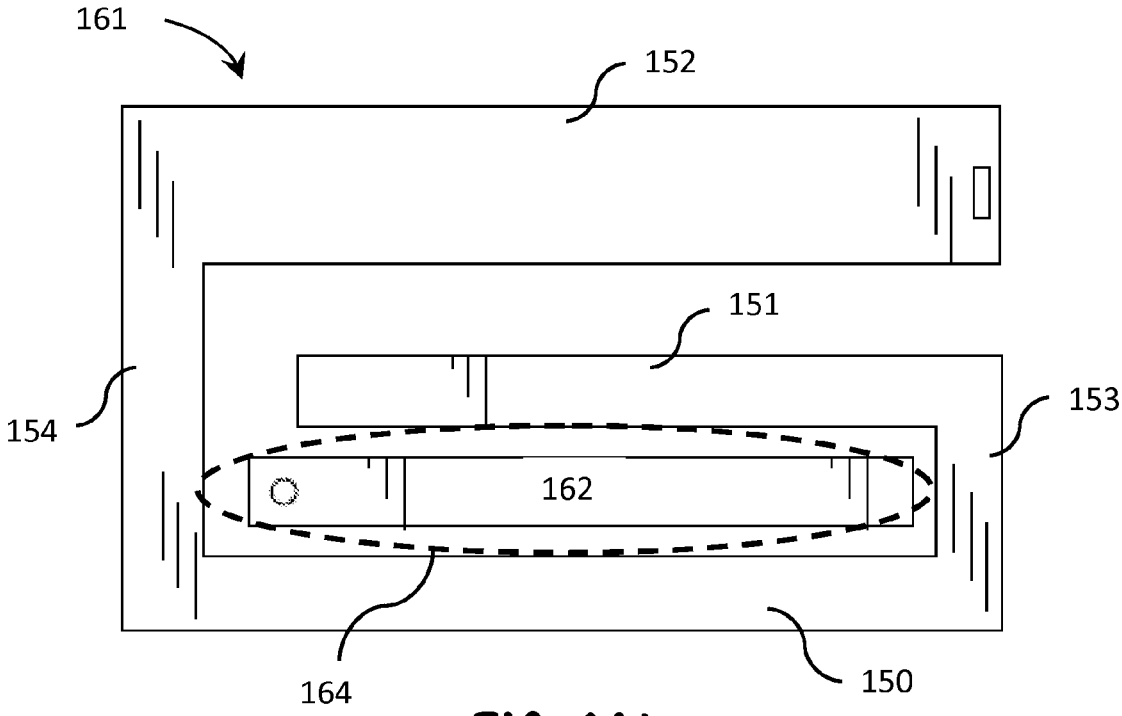

In another embodiment, as illustrated in FIGS. 16*a*-16*b*, a planar IMD antenna element 161 is disposed above a ground plane as described in FIG. 15; the IMD antenna element includes a first slot portion 164 formed in the space between the first and second parallel conductor portions 150; 151, and the first and second perpendicular conductor portions 153; 154. The first slot portion 164 is denoted by dashed lines in FIG. 16*b*. In practice, the planar IMD antenna 161 exhibits a dual resonance characteristic, wherein a first resonance band can be tuned by placing the parasitic within or near an area extending from the ground plane to the first slot portion 164.

Figure 17A:
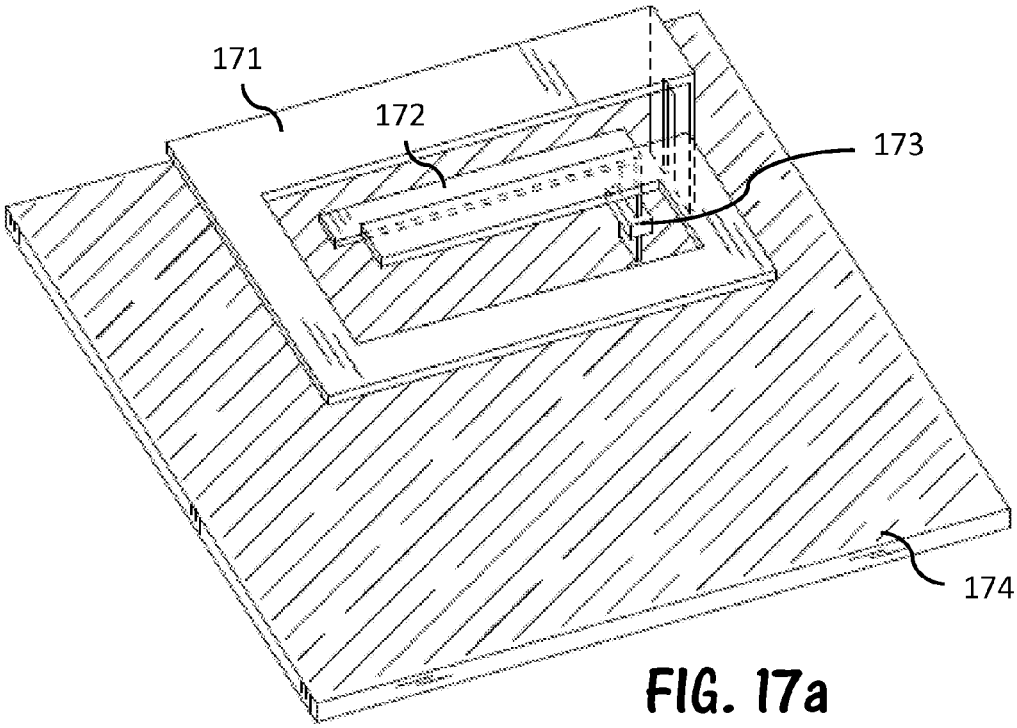
FIG. 17*a*-17*b* illustrates an antenna according to another preferred embodiment of the invention.
Figure 17B:
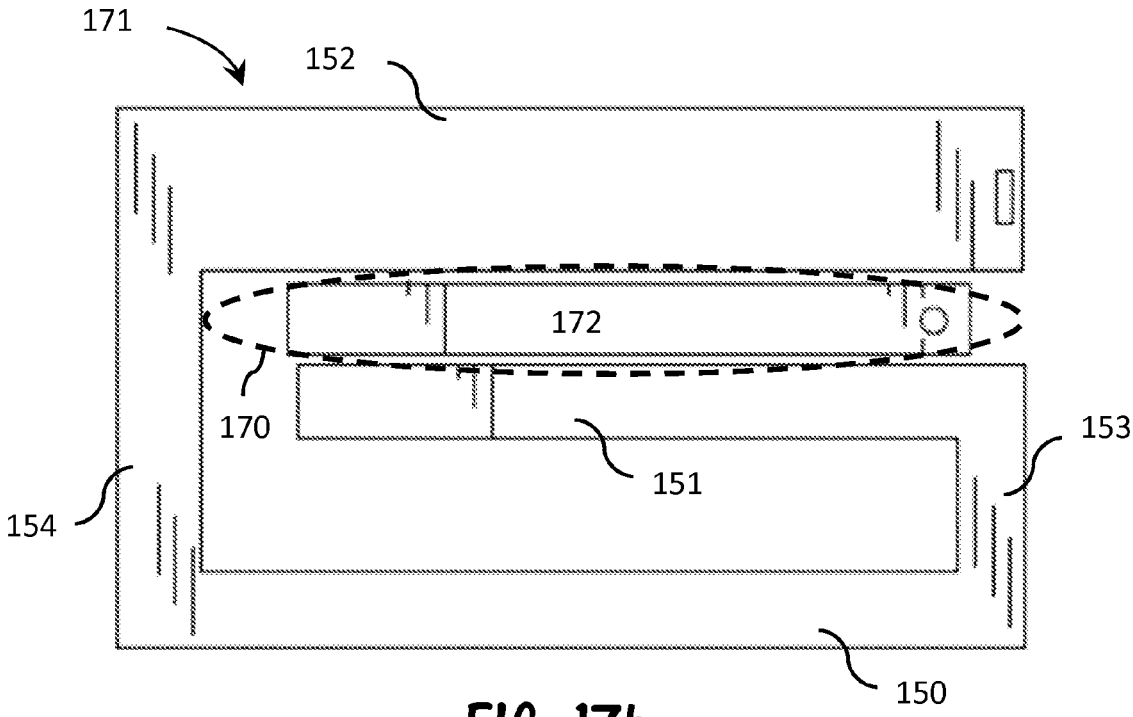

In another embodiment, as illustrated in FIGS. 17*a*-17*b*, a planar IMD antenna element 171 is disposed above a ground plane as described in FIG. 15; the IMD antenna element includes a second slot portion 170 formed in the space between the second and third parallel conductor portions 151; 152, and the second perpendicular conductor portion 154. The second slot portion 170 is denoted by dashed lines in FIG. 17*b*. In practice, the planar IMD antenna 171 exhibits a dual resonance characteristic, wherein a second resonance band can be tuned by placing the parasitic within or near an area extending from the ground plane to the second slot portion 170. The active tuning element 173 attached to the parasitic allows on/off switching, or a variable tuning capability such as can be provided by a varicap or similar component, such that the second resonance band can be tuned or shifted by controlling the active element 173.

Figure 18A:
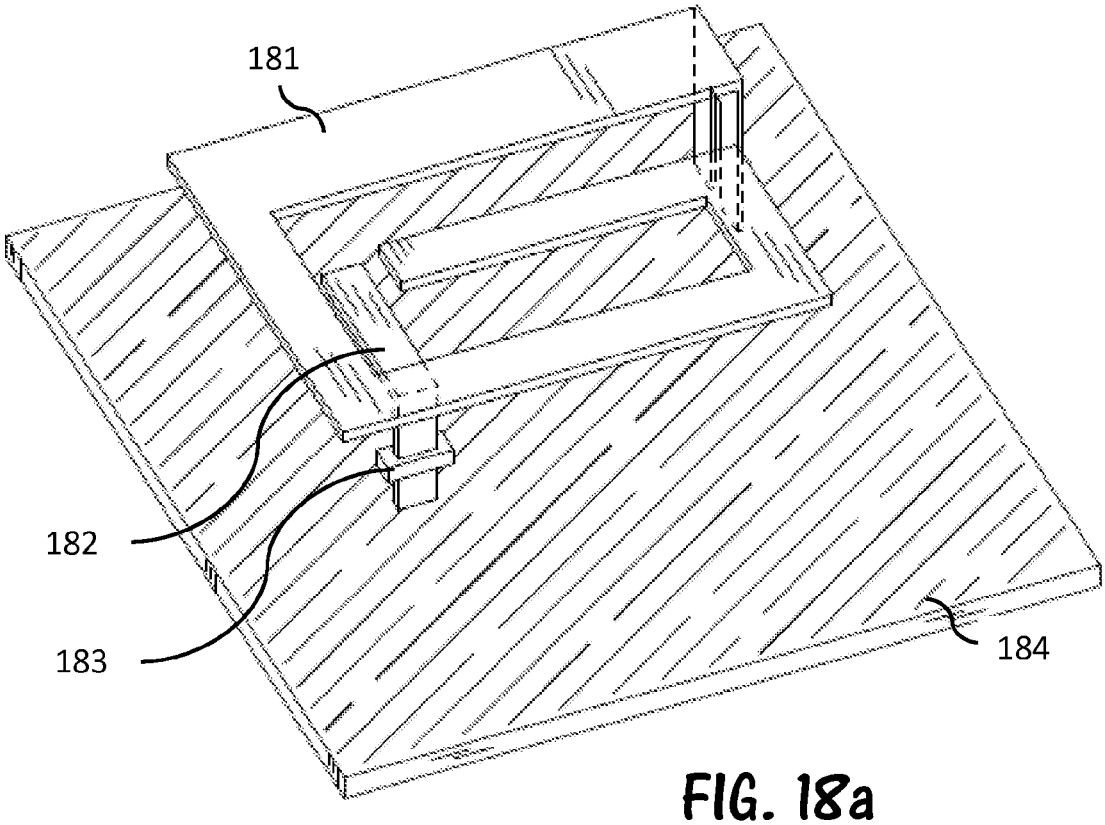
FIG. 18*a*-18*b* illustrates an antenna according to another preferred embodiment of the invention.
Figure 18B:
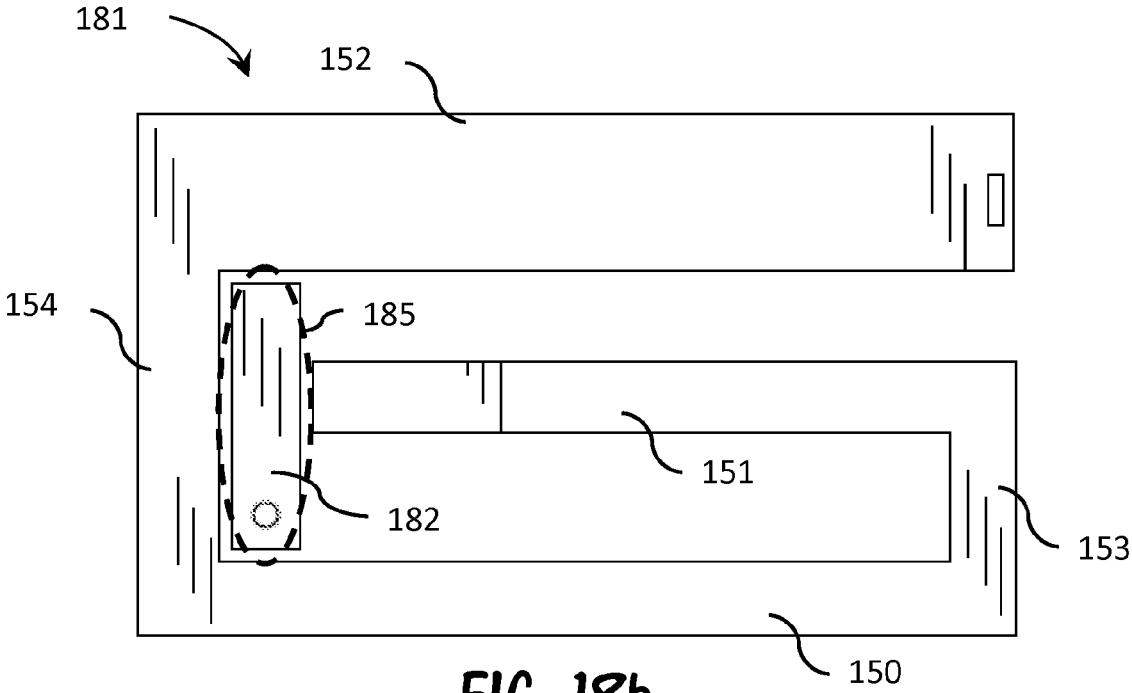

In yet another embodiment, as illustrated in FIGS. 18*a*-18*b*, a planar IMD antenna element 181 is disposed above a ground plane as described in FIG. 15; the IMD antenna element includes a third slot portion 185 formed in the space between the first, second and third parallel conductor portions 150; 151; 152, and the second perpendicular conductor portion 154. The second slot portion 185 is denoted by dashed lines in FIG. 18*b*. In practice, the planar IMD antenna 171 exhibits a dual resonance characteristic, wherein both the first and second resonance bands can be tuned by placing the parasitic within or near an area extending from the ground plane to the third slot portion 185.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. An antenna capable of active frequency shifting, comprising:

a spiral-shaped conductor element substantially disposed within a horizontal plane and having at least one slot portion therein, said conductor element disposed within said horizontal plane being positioned at a distance above a ground plane to form a volume of the antenna therebetween;

at least one parasitic element positioned at least partially within said volume of the antenna; and at least one active tuning element connected to said parasitic element and adapted for one or more of: switching said parasitic element to ground, or varying a reactance for tuning the antenna.

2. The antenna of claim 1, wherein said at least one active tuning element is selected from the group consisting of: voltage controlled tunable capacitors, voltage controlled tunable phase shifters, FET's, and switches.

3. The antenna of claim 1, wherein said at least one active tuning element includes a first active tuning element positioned on said parasitic element.

4. The antenna of claim 3, wherein said at least one active tuning element further includes a second active tuning element positioned on said spiral-shaped conductor.

5. The antenna of claim 1, wherein said at least one parasitic element includes a first parasitic element at least partially positioned in a space between said ground plane and said at least one slot portion.

6. The antenna of claim 5, wherein said at least one slot portion includes a first slot portion and a second slot portion.

7. The antenna of claim 6, wherein said first parasitic element is at least partially positioned within a space between said ground plane and said first slot portion.

8. The antenna of claim 7, further comprising a second parasitic element, wherein said second parasitic element is at least partially positioned in a space between said ground plane and said second slot portion.

9. The antenna of claim 7, wherein said first parasitic element is adapted to shift a first resonant frequency characteristic of the spiral shaped conductor element.

10. The antenna of claim 8, wherein said second parasitic element is adapted to shift a second resonant frequency characteristic of the spiral shaped conductor element.

11. The antenna of claim 10, wherein said first and second parasitic elements are each attached to an active tuning element for actively adjusting one or more frequency characteristics of the antenna.

12. An antenna capable of active frequency shifting, comprising:

a spiral-shaped conductor having a first parallel conductor portion connected to a second parallel conductor portion by a first perpendicular conductor portion extending therebetween, said first parallel conductor portion further connected to a third parallel conductor portion by a second perpendicular conductor portion extending therebetween, said first through third parallel conductor portions and said first and second perpendicular conductor portions each disposed within a common plane, wherein said first and second parallel conductor portions are spaced apart at a first slot portion and adapted to form a capacitive coupling therebetween, and wherein said first through third parallel conductor portions and said first and second perpendicular conductor portions are arranged to provide a loop current along said spiral-shaped conductor;

at least one parasitic element positioned near said spiral-shaped conductor and adapted to shift a resonant frequency characteristic of the spiral-shaped conductor; and at least one active tuning element connected to said parasitic element and adapted for one or more of: switching said parasitic element to ground, or varying a reactance for tuning the antenna.

13. The antenna of claim 12, wherein said active tuning element is selected from the group consisting of: voltage controlled tunable capacitors, voltage controlled tunable phase shifters, FET's, switches, MEMs device, and transistor.

14. The antenna of claim 12, wherein said at least one active tuning element includes a first active tuning element positioned on said at least one parasitic element.

15. The antenna of claim 14, wherein said at least one parasitic element further includes a second parasitic element, and wherein said at least one active tuning element further includes a second active tuning element connected to said second parasitic element.

16. An antenna capable of active frequency shifting, comprising:

a spiral-shaped planar conductor element substantially disposed within a horizontal plane and positioned at a height above a ground plane, said spiral-shape planar conductor element having one or more slot portions; and a parasitic element positioned between said ground plane and said slot portion for tuning a resonant frequency characteristic of the antenna, wherein said parasitic element is connected to an active tuning element for actively adjusting a coupling between said parasitic element and said spiral-shaped planar conductor element.

17. The antenna of claim 16, wherein said active tuning element is further connected to said ground plane for shorting said parasitic element.

18. The antenna of claim 17, wherein said at least one active tuning element is selected from the group consisting of: voltage controlled tunable capacitors, voltage controlled tunable phase shifters, FET's, switches, MEMs device, and transistor.

* * * * *